US008177060B2

(12) United States Patent
Kim

(10) Patent No.: US 8,177,060 B2
(45) Date of Patent: May 15, 2012

(54) RETAIL BOX FOR DISPLAYING A TIE

(75) Inventor: Cin Kim, Alpine, NJ (US)

(73) Assignee: Peacock Apparel Group, Inc., New York, NY (US)

( * ) Notice: Subject to any disclaimer, the term of this patent is extended or adjusted under 35 U.S.C. 154(b) by 645 days.

(21) Appl. No.: 12/267,580

(22) Filed: Nov. 8, 2008

(65) Prior Publication Data

US 2009/0152140 A1 Jun. 18, 2009

Related U.S. Application Data

(60) Provisional application No. 61/014,197, filed on Dec. 17, 2007.

(51) Int. Cl.
*B65D 85/18* (2006.01)

(52) U.S. Cl. ..... 206/293; 206/278; 206/292; 190/34

(58) Field of Classification Search ..... 206/8, 292, 206/293, 278; 190/13 C, 34; 211/85.3
See application file for complete search history.

(56) References Cited

U.S. PATENT DOCUMENTS

| | | | | |
|---|---|---|---|---|
| 76,186 | A * | 3/1868 | Hart, Jr. | 206/293 |
| 780,849 | A * | 1/1905 | Wilkins | 206/8 |
| 872,874 | A * | 12/1907 | Wheary | 190/13 C |
| 1,662,039 | A * | 3/1928 | Heynen | 206/747 |
| 1,995,864 | A * | 3/1935 | Reinhold | 206/278 |
| 2,082,011 | A * | 6/1937 | Lee | 206/293 |
| 3,066,792 | A * | 12/1962 | Spilman et al. | 206/299 |
| 3,670,881 | A * | 6/1972 | Dutcher | 229/125.015 |
| 5,762,191 | A * | 6/1998 | Etzion et al. | 206/348 |
| 6,142,365 | A * | 11/2000 | Breitbach | 229/198.2 |
| 6,499,590 | B1 * | 12/2002 | Godshaw et al. | 206/278 |
| 2005/0109644 | A1 * | 5/2005 | Kim | 206/278 |
| 2006/0042972 | A1 * | 3/2006 | Kim | 206/278 |

* cited by examiner

*Primary Examiner* — Sue Weaver
(74) *Attorney, Agent, or Firm* — Leason Ellis LLP

(57) ABSTRACT

A tie box suitable for receiving one or more ties includes a base structure having a floor and upstanding peripheral walls that extend outwardly therefrom to define an interior compartment and a cover that is constructed to mate with the base structure. The tie box includes at least one elastic tie retaining member that is disposed within the interior compartment for receiving and holding the tie between the elastic tie retaining member and the floor. A ribbon member is disposed within the interior compartment for tying around the tie.

13 Claims, 4 Drawing Sheets

RETAIL BOX FOR DISPLAYING A TIE

CROSS REFERENCE TO RELATED APPLICATION

This present application claims the benefit of U.S. patent application Ser. No. 61/014,197, filed Dec. 17, 2007, which is hereby incorporated by reference in its entirety.

TECHNICAL FIELD

The present invention relates to retail packaging and in particular, to a tie box for displaying a tie in a folded state and in an attractive manner at the point of sale.

BACKGROUND

In the retail sale of dress shirts and ties, it is desirable to present the merchandise in a manner that permits potential customers to have a good took at the product. On the other hand, it is important for retailers to keep the product clean aid free of any soil or stains that may result from handling, to protect against theft, and to maintain the clothing (ties) in an orderly and well-folded condition so that their displays remains attractive to passers by.

It is also desirable that the packaging not only securely holds the tie in its display state but also, the packaging preferably includes a ribbon or the like that makes the tie and its packaging more presentable and attractive as a gift.

The embodiments described herein satisfy these and other needs.

SUMMARY

A tie box suitable for receiving one or more ties includes a base structure having a floor and upstanding peripheral walls that extend outwardly therefrom to define an interior compartment and a cover that is constructed to mate with the base structure. The tie box includes at least one elastic tie retaining member that is disposed within the interior compartment for receiving and holding the tie between the elastic tie retaining member and the floor. A ribbon member is disposed within the interior compartment for tying around the tie.

These and other aspects, features and advantages shall be apparent from the accompanying Drawings and description of certain embodiments of the invention.

DETAILED DESCRIPTION OF CERTAIN EMBODIMENTS OF THE INVENTION

Figure 1:
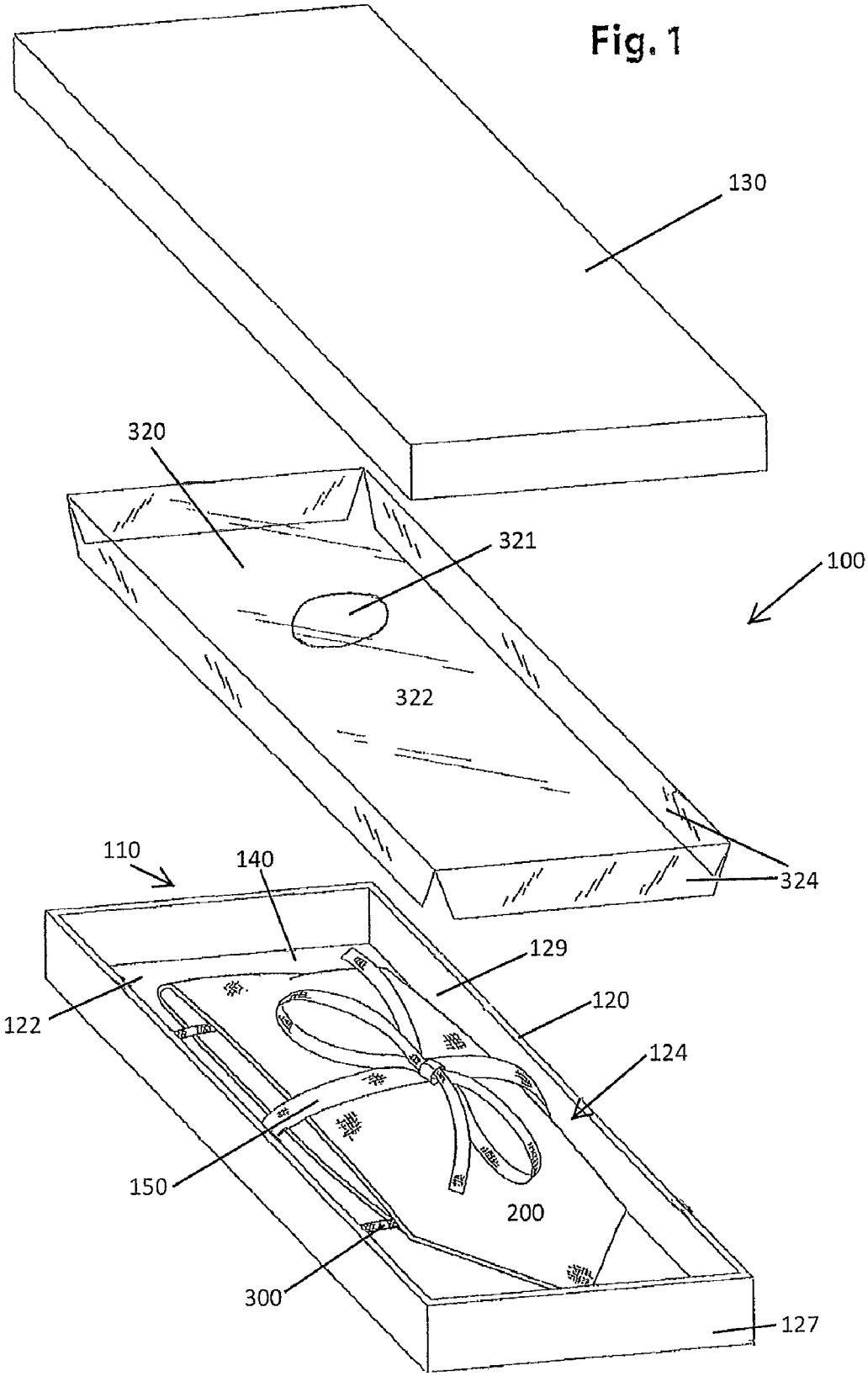
FIG. 1 is an exploded perspective view of a tie box according to one embodiment of the invention in an unassembled state.
Figure 2:
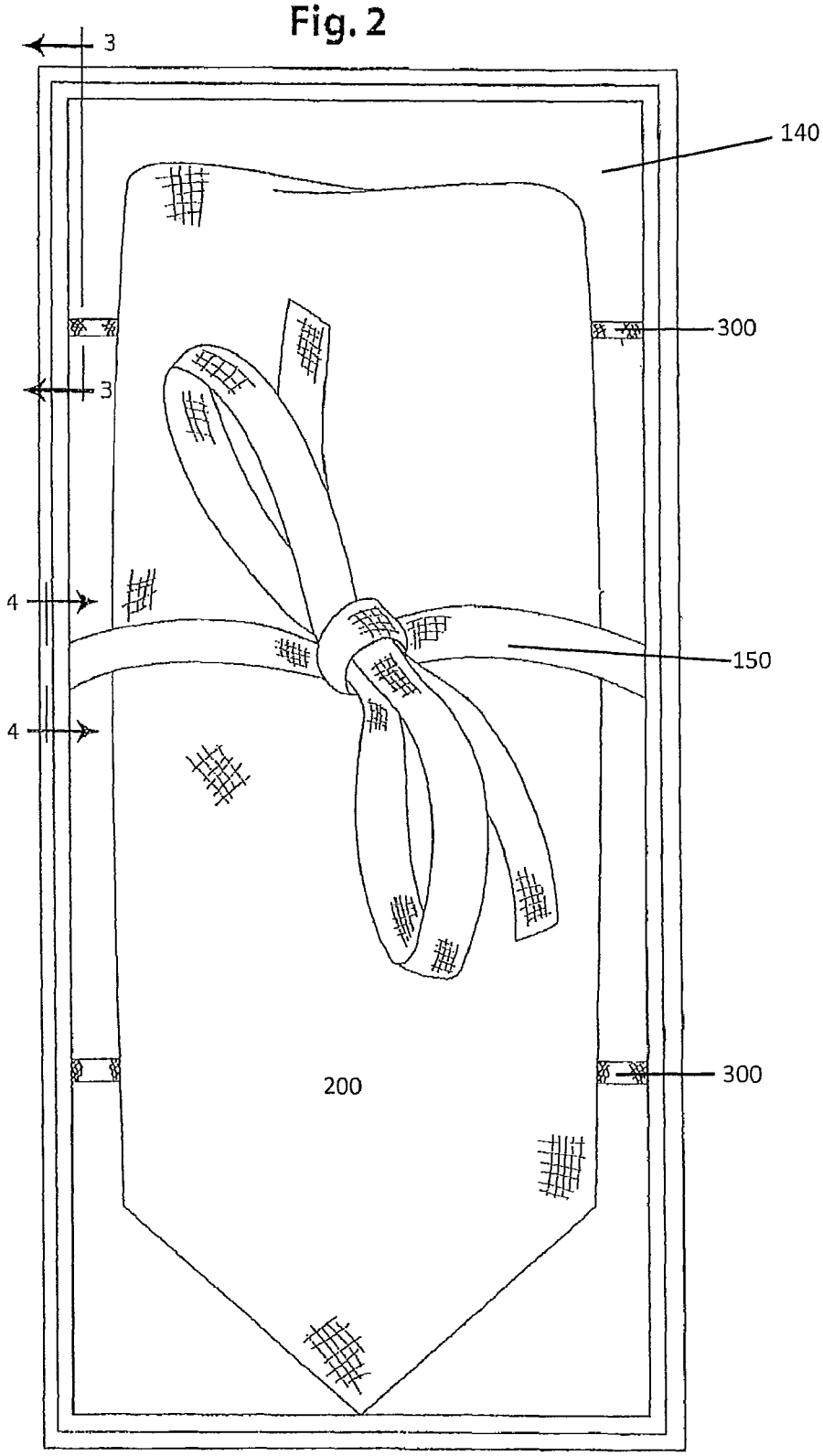
FIG. 2 is a front view of the tie box without the cover and showing a tie arrangement.
Figure 3:
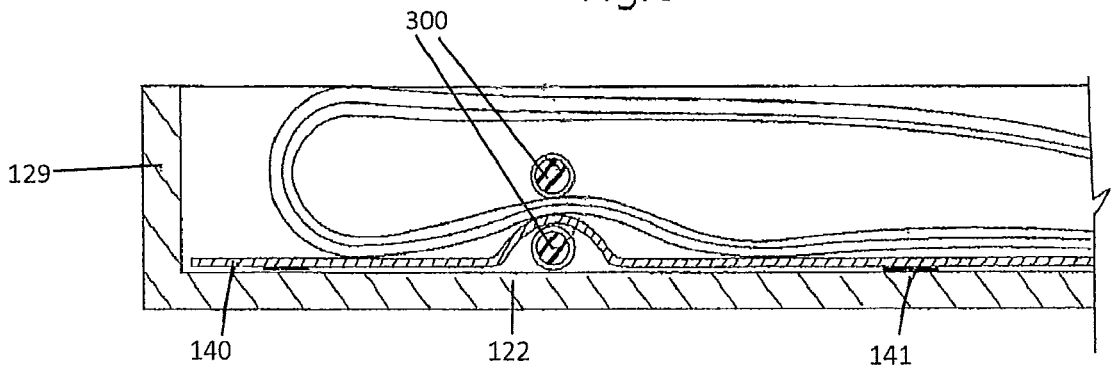
FIG. 3 is a cross-sectional view taken along the line 3-3 of FIG. 2.
Figure 4:
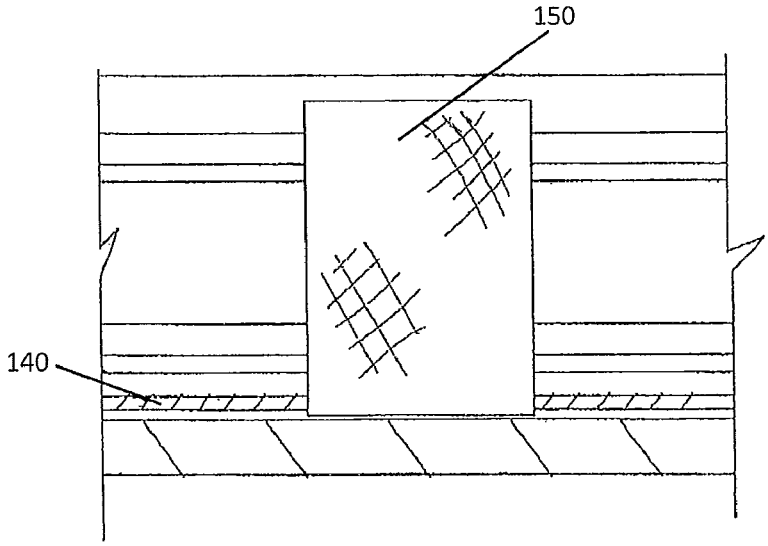
FIG. 4 is a cross-sectional view taken along the line 4-4 of FIG. 2.

FIGS. 1-4 illustrate a tie box container and display 100 that is configured to attractively hold and display a tie 200. The display 100 includes a box 110 that is formed of a base 120 and a cover 130. The precise shape of the box 110 (base 120 and cover 130) is not critical; however, the base 120 generally includes a floor 122 and a side wall structure 124 that extends upwardly from the floor 122. In the illustrated embodiment, the base 120 has a rectangular shape since when the tie 200 is folded over itself, it assumes a rectangular shape. The side wall structure 124 thus includes a pair of opposing end walls 127 and a pair of opposing side walls 129, all of which extend upwardly from the floor 122. For example, the walls 127, 129 form right angles with the floor 122.

The base 120 includes a means for holding the tie 200 in place along the floor 122 thereof. For example, the means can be in the form of one or more flexible binders 300 that are associated with and coupled to the floor 122. For example, the flexible binder(s) 300 can be in the form of an elastic or rubber band. In one embodiment, at least two flexible binders 300 are used in constructing the base 120. The flexible binders 300 are attached to and coupled to the base 120. For example, one or more segments or points of the flexible binder 300 are attached to the floor 122, side walls 129 or both. The flexible binder 300 is coupled to the base 120 so that it extends across the base 120 (side wall to side wall) and on top of the floor 122 such that a portion of the flexible binder 300 can be lifted and stretched to create and define a space between the stretched binder and the floor 122.

In one embodiment, the base 120 and cover 130 are formed of a paper material, such as rigid, cardboard.

Instead of directly connecting the flexible binders (elastic bands) to the base 120, a floor covering 140 can be used to partially cover the elastic bands 300 and provide a means for securely holding the elastic bands 300 in place. More specifically, the floor covering 140 can be in the form of a paper product or sheet that is folded a number of times to form a multi-layer structure or it can be a single layer structure. The floor covering 140 is sized so that it can be inserted into the base 120 between the ends 127 and sides 129. The floor covering 140 thus sits above the floor 122 so as to cover the floor 122.

In either embodiment, the floor covering 140 has a first surface (upper surface) that faces upwardly away from the floor 122 and the second surface (lower surface) that faces the floor 122. Since the upper surface of the floor covering 140 is visible in the box, it can have a decorative pattern or some other type of indicia. In addition, a corporate logo or the like can be formed on the upper surface.

The looped elastic bands 300 are disposed about the floor covering 140 such that the floor covering 140 is disposed through the openings of the elastic bands 300. In other words, one portion (semi-circular portion) of the elastic band 300 is disposed beneath the floor covering 140, while another portion (semi-circular portion) of the elastic band 300 is disposed above the upper surface. In a rest position (not stretched), the elastic band 300 seats against the upper surface of the floor covering 140; however, the flexible nature of the elastic band 300 permits the portion of the elastic band 300 above the upper surface of the floor covering 140 to be extended and stretched so as to create a gap or space that is of sufficient size to receive the folded tie 200.

In the illustrated embodiment, there are two elastic bands 300 with one being spaced from one end 129 of the base 120 and the other being spaced from the other end 129 of the base 120. The two elastic bands 300 thus provide two locations for the tie 200 to be securely attached to the base 120. The elastic bands 300 can thus be endless bands.

The floor covering 140 can be attached to the floor 122 using any number of conventional means, including the use of an adhesive, such as glue. Alternatively, the floor covering 140 can be attached with a tack, staple or the like (shown at 141). The floor covering 140 can also be held within the base 120 by a friction fit.

The base 120 also includes a ribbon or the like 150 that similar to the elastic bands 300 serve a function and likewise provides a decorative and aesthetic function. The ribbon 150 is associated with the base 120 and in particular, the ribbon 150 is associated with the floor 122. In one embodiment, the ribbon 150 can be provided in two segments, namely a first segment and a second segment. The first segment is coupled to the floor or side wall, while the second segment is coupled to the floor or the other side wall. Each of the first and second segments has a free end that is for attachment to the free end of the other segment. The floor covering 140 is disposed over at least a portion of the first and second segments so as to cover where the segments interface with the floor 122. When the tie 200 is disposed over the floor covering 140, the first and second ribbon segments are looped over the tie 200 and then tied into a bow.

In another embodiment and similar to the elastic bands 300 described above, the ribbon 150 is not segments but rather is a single continuous strip of material. The ribbon 150 is coupled to the base 120 by inserting the ribbon 150 underneath the floor covering such that the two free ends of the ribbon 150 are accessible. In other words, a center portion of the ribbon 150 is disposed under the floor covering 140; however, the free end sections of the ribbon 150 are free. The continuous strip of ribbon material can be attached to the underside of the floor covering 140 or, as illustrated, the ribbon material 150 can be loose and not attached to the floor covering 140. In this embodiment, the attachment of the floor covering 140 to the base 120 serves to securely hold the ribbon 150 in place since the ribbon 150 is captured between the floor covering 140 and the floor 122. After the tie 200 is inserted and secured to the floor covering 140 using the elastic bands 300, the free ends of the ribbon material (strip) are tied in a bow to present an attractive package and showcase the tie 200.

It will be appreciated that some level of color coordination can be done between the tie 200 and the color of the ribbon material 150. For example, the ribbon 150 can have the major color of the tie 200 or it can have a contrasting color. In addition or alternatively, the color of the ribbon 150 can be coordinated with the color of the floor covering 140. In one embodiment, the major or principle color of the floor covering 140 and the ribbon 150 is the same.

The length of the continuous ribbon 150 is such that when the free ends thereof are tied to form the illustrated bow, the tied ribbon still has dimensions that permit it to generally be disposed within the base 120 in that excess ribbon material does not hang over the walls of the base 120.

The ribbon 150 is disposed in the illustrated embodiment between the two elastic bands 300.

It will be appreciated that the box cover 130 is sized so that the base 120 can be received into the cover 130 with the side and end walls of the cover 130 being disposed outside of the side and end walls of the base 120.

In one embodiment, the cover 130 or the base 120 or both can include an opening (not shown) that permits a customer to touch a portion of the tie 200 so as to feel the quality of the material prior to purchase. The opening can be located in the cover 130 at a location that is above the tie 200 when the cover 130 is placed on the base 120. The size and shape of the opening can vary and be selected based on a given application/product. For example, the opening can be in the form of a circular or oval shaped opening. The opening can be formed in the end wall or even the side wall of either the base 120 or the cover 130.

A plastic cover 320 or the like can be inserted and disposed over the open base 120. The cover 320 has a main section 322 that can be disposed over the tie 200 when the plastic cover 320 is inserted into the base 120. The plastic cover 320 is formed of the main section 322 and a number of side and end flaps 324 that are inserted into the base 120 such that the tie 200 is visible through the transparent main section 322. The side and end flaps 324 are disposed outside of the tie 200 but inside the side and end walls of the base 120.

In one embodiment, the cover 320 has an opening 321 that is formed in the main section 322 to permit the consumer to feel the fabric of the tie 200. As previously mentioned, the opening 321 can come in any number of different sizes and shapes so long as the consumer can place a finger therein to feel the quality and texture of the tie 200. In the illustrated embodiment, the opening 321 has an oval shape. However, other shapes can include square, octagon, circle, triangle, etc.

Figure 5:
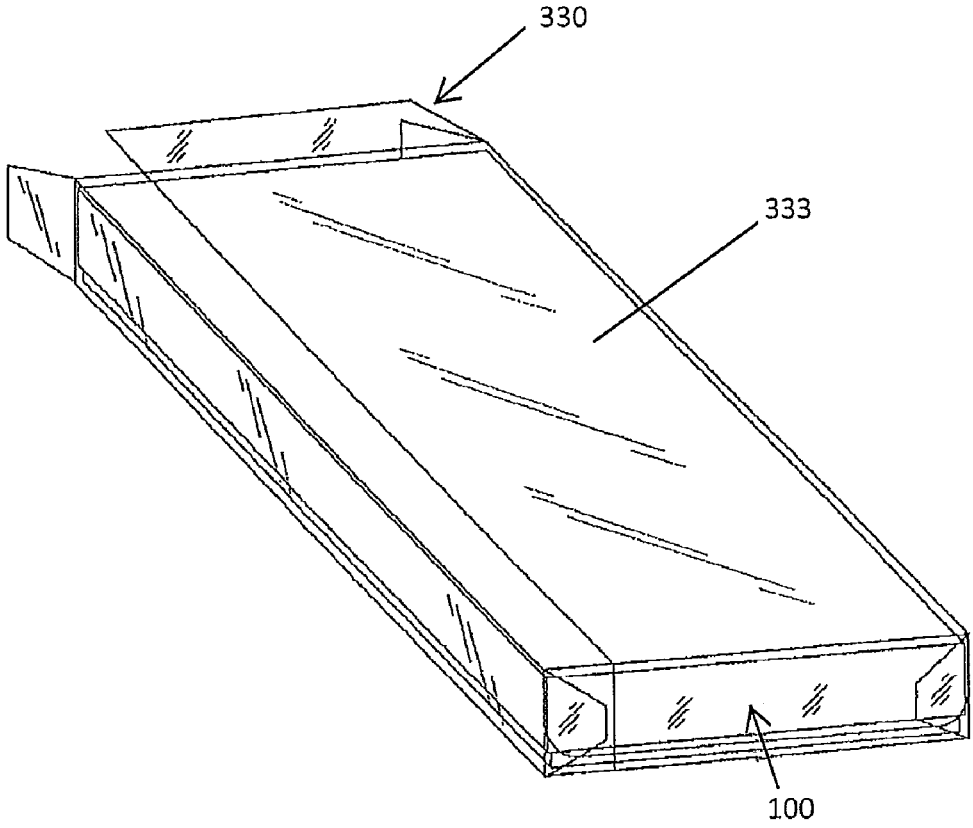
FIG. 5 is the tie box of FIG. 1 in an assembled state and inserted into a transparent cover box.

Alternatively and as shown in FIG. 5, the box 100 can be inserted into a transparent plastic box 330. The box 330 is formed of a single sheet of plastic and includes fold lines that permit the box 330 to be folded to define end tabs for closing up the ends of the box 330. When the box 100 is to be inserted into the box 330, the cover 130 is placed over and securely attached to the base 120 and then one set of end flaps are closed. A top panel 333 is then folded over the cover 130.

Similar to the cover 320, the plastic box 330 can include an opening that is formed in the top panel 333 thereof that lies above the tie 200. The opening permits the consumer to feel the fabric of the tie 200. The opening can come in any number of different sizes and shapes so long as the consumer can place a finger therein to feel the quality and texture of the tie 200. In the illustrated embodiment, the opening has an oval shape.

The openings thus are designed to permit touching of the tie without jeopardizing the integrity of the box.

In either embodiment, the protective covering is formed of a transparent material, such as a clear plastic. However, colored transparent plastics can also be used.

The tie box can include other accessories, such as a handkerchief and/or cuff links, or other items that may be used in combination with a tie, such as a tie clip, etc.

While the invention has been described in connection with certain embodiments thereof the invention is capable of being practiced in other forms and using other materials and structures. Accordingly, the invention is defined by the recitations in the claims appended hereto and equivalents thereof.

What is claimed is:

1. A tie box suitable for receiving one or more ties comprising:

a base structure having a floor and upstanding peripheral walls that extend outwardly therefrom to define an interior compartment;

a protective floor cover member that is configured to be disposed along the floor;

a cover that is constructed to mate with the base structure;

a pair of elastic tie retaining members that are in the form of a pair of endless elastic bands, the elastic bands being disposed within the interior compartment for receiving and holding the tie between the elastic bands and the floor, wherein the elastic bands surround the protective floor cover member such that bottom sections of the elastic bands are not visible since they lie below the protective floor cover member and upper sections of the elastic bands extend across a top surface of the protective floor cover member; and a ribbon member that is disposed within the interior compartment for tying around the tie, the ribbon member having two free ends and being disposed partially below the floor protective floor cover member by extending tranversely across an underside thereof such that the free ends are accessible above the protective floor cover member, the ribbon member being disposed between the pair of elastic bands, wherein attachment of the protective floor cover member to the base securely holds the ribbon member and the elastic bands in place and prevents free access thereto.

2. The tie box of claim 1, wherein each of the elastic bands comprises a rubber band.

3. The tie box of claim 1, wherein the protective floor cover member comprises a folded paper structure that has side and end edges that abut respective side and ends of the base.

4. The tie box of claim 1, wherein the protective floor cover member is held within the interior compartment by a frictional fit with the walls of the base.

5. The tie box of claim 1, wherein the protective floor cover member is attached to the floor with an adhesive.

6. The tie box of claim 1, wherein the elastic bands and the ribbon member are not directly attached to the protective floor cover member.

7. The tie box of claim 1, wherein the protective floor cover member has a predominant color that is the same as the predominant color of the tie.

8. The tie box of claim 1, wherein the ribbon member is a single continuous length of material that is disposed underneath the protective floor cover member with the two free ends being accessible for tying into a how.

9. The tie box of claim 1, further including a flexible transparent cover that has sides and ends, the transparent cover being inserted into the interior compartment surrounding the tie.

10. The tie box of claim 9, wherein the flexible transparent cover includes an opening formed therein to permit a consumer to touch the tie that is located within the interior compartment.

11. The tie box of claim 9, wherein the flexible transparent cover is formed of a clear plastic material.

12. The tie box of claim 1, further including a flexible, transparent outer box that has an inner space that receives the tie box so as to completely surround the tie box, the transparent outer box having at least one openable end.

13. The tie box of claim 12, wherein the outer box includes an opening formed therein to permit a consumer to touch the tie that is located within the interior compartment.

* * * * *